US006729461B2

(12) United States Patent
Brandle et al.

(10) Patent No.: US 6,729,461 B2
(45) Date of Patent: May 4, 2004

(54) METHODS AND APPARATUS FOR DETECTION OF COIN DENOMINATION AND OTHER PARAMETERS

(75) Inventors: Daniel Brandle, Amrisil (CH); Klaus Muller, Heidelberg (DE); Robert L. Zwieg, Watertown, WI (US); Thomas P. Adams, Oconomowoc, WI (US); John P. Grajewski, Palmyra, WI (US)

(73) Assignee: De La Rue Cash Systems, Inc., Watertown, WI (US)

( * ) Notice: Subject to any disclaimer, the term of this patent is extended or adjusted under 35 U.S.C. 154(b) by 28 days.

(21) Appl. No.: 09/945,888

(22) Filed: Sep. 4, 2001

(65) Prior Publication Data

US 2002/0074210 A1 Jun. 20, 2002

Related U.S. Application Data

(60) Provisional application No. 60/230,577, filed on Sep. 5, 2000.

(51) Int. Cl.[7] ..... G07D 5/02; G07D 5/08

(52) U.S. Cl. ..... 194/317; 194/334

(58) Field of Search ..... 194/334, 317, 194/318, 331; 453/4

(56) References Cited

U.S. PATENT DOCUMENTS

| | | | | | |
|---|---|---|---|---|---|
| 3,788,440 | A | * | 1/1974 | Propice et al. | 194/318 |
| 3,916,194 | A | * | 10/1975 | Novak et al. | 250/338.1 |
| 4,088,144 | A | | 5/1978 | Zimmerman | |
| 4,089,400 | A | * | 5/1978 | Gregory | 194/331 |
| 4,249,648 | A | | 2/1981 | Meyer | |
| 4,467,202 | A | * | 8/1984 | Nakamura et al. | 250/338.3 |
| 4,531,625 | A | * | 7/1985 | Yonekura et al. | 194/334 |
| 4,601,380 | A | * | 7/1986 | Dean et al. | 194/318 |
| 5,285,883 | A | * | 2/1994 | Le Hong et al. | 194/317 |
| 5,351,798 | A | | 10/1994 | Hayes | |
| 5,551,542 | A | | 9/1996 | Stockli | |
| 5,568,854 | A | | 10/1996 | Hayes et al. | |
| 5,684,597 | A | * | 11/1997 | Hossfield et al. | 356/635 |
| 5,788,046 | A | | 8/1998 | Lamah | |
| 5,908,712 | A | * | 6/1999 | Chatterjee et al. | 428/699 |
| 6,042,470 | A | * | 3/2000 | Geib et al. | 453/10 |
| 6,139,418 | A | | 10/2000 | Geib et al. | |
| 6,148,987 | A | | 11/2000 | Bernier et al. | |

FOREIGN PATENT DOCUMENTS

EP 683 473 A2 11/1995

* cited by examiner

*Primary Examiner*—F. J. Bartuska
(74) *Attorney, Agent, or Firm*—Quarles & Brady LLP

(57) ABSTRACT

A coin sorting apparatus and method uses a light source (50) disposed on one side of the coin path (23); a coin moving member (21) of light transmissive material; a coin path insert (41) having at least a portion the is light transmissive; an optical detector (55) disposed on an opposite side of the coin path (23) from the light source (50) for detecting coin size as a coin (14) passes the coin path insert (41); a coin core alloy composition sensor (42); a coin surface alloy composition sensor (43); an edge sensor (46) disposed along a reference edge (45) along the coin path; and a plurality of processors (90, 94, 95, 107, 96) for receiving data developed from signals from the optical detector (55), the coin core alloy sensor (42), the coin surface (43) alloy detector, and the coin edge sensor (46), the data being for comparison with stored values for a plurality of denominations to determine the denomination of the coin (14). A lens array (56) helps direct light from the light source (55) to the optical detector (55). The coin path insert can have an upper surface of zirconia ceramic (34, 35) with a sapphire window (49), or the upper surface can be an integral sapphire element (37).

40 Claims, 11 Drawing Sheets

METHODS AND APPARATUS FOR DETECTION OF COIN DENOMINATION AND OTHER PARAMETERS

CROSS-REFERENCE TO RELATED APPLICATIONS

The benefit of priority of U.S. Provisional Appl. No. 60/230,577 filed Sep. 5, 2000, is claimed herein.

TECHNICAL FIELD

The invention relates to coin processing equipment and, more particularly, to coin sorters.

BACKGROUND ART

In Zwieg et al., U.S. Pat. No. 5,992,602, coins were identified by using an inductive sensor to take three readings as each coin passed through a coin detection station and these readings were compared against prior calibrated limits for the respective denominations.

Optical sensing of coins in coin handling equipment has been employed in Zimmermann, U.S. Pat. No. 4,088,144 and Meyer, U.S. Pat. No. 4,249,648. Zimmermann discloses a rail sorter with a row of photocells. Zimmermann does not disclose repeated measurements of a coin dimension as it passes the array, but suggests that there may have been a single detection of the largest dimension of the coin based on the number of photocells covered by a coin as it passes. Zimmermann does not disclose the details of processing any coin sensor signals derived from its photosensor.

Meyer, U.S. Pat. No. 4,249,648, discloses optical imaging of coins in a bus token collection box in which repeated scanning of chord length of a coin is performed by a 256-element linear light sensing array. Light is emitted through light transmissive walls of a coin chute and received on the other side of the coin chute by the light sensing array. The largest chord length is compared with stored acceptable values in determining whether to accept or reject the coin.

It has also been known in the prior art to detect invalid coins using various types of inductive sensors. Examples of these are disclosed in Hayes, U.S. Pat. No. 5,568,854 and Hayes, U.S. Pat. No. 5,351,798 and Bernier, U.S. Pat. No. 6,148,947.

SUMMARY OF THE INVENTION

The invention relates to a sensor for a coin sorter and methods for rapidly and accurately identifying coins having up to at least eighteen different coin specifications.

The sensor utilizes an optical sensor to detect coin size, and also utilizes a core alloy sensor, a surface alloy sensor and edge alloy/thickness sensor to develop multiple parameters for accepting or rejecting a coin.

In one embodiment, the sensor utilizes five microcontrollers to read in data for size, a surface alloy, a core alloy, and an edge alloy/thickness parameter. In another embodiment only size is measured.

One object of the present invention is to use a coin detection sensor that will process up to 4500 coins per minute.

Another object of the invention is to provide a rotatable light transmissive coin moving member. Such a large light transmissive member has not been seen in the prior art.

Another object of the present invention is to provide an enhanced type of contactless coin sensor assembly for both coin counting and for detection of invalid coins for offsorting.

Another object of the invention is to provide a ceramic coin path insert over which the coins pass, when passing through the sensor, which coin path insert avoids absorption of metal from the coins.

In one embodiment light is passed through a sapphire window in the coin path insert to be received by a linear sensing array with 768 elements. In another embodiment, the upper surface of the coin path insert is formed by an integral, transparent, sapphire element.

The optical imaging sensor using a hardware logic circuit to rapidly measure a coin dimension a number of times, so that data is not skewed by nicks in the rim of the coins. The alloy sensors are arranged to take readings from the body of the coins and inward from the edges of coins in response to the coin covering or uncovering a trigger point.

While the present invention is disclosed in a preferred embodiment based on Zwieg et al., U.S. Pat. No. 5,992,602, the invention could also be applied as a modification to other types of machines, including the other prior art described above.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention.

DETAILED DESCRIPTION OF THE PREFERRED EMBODIMENTS

Figure 1:
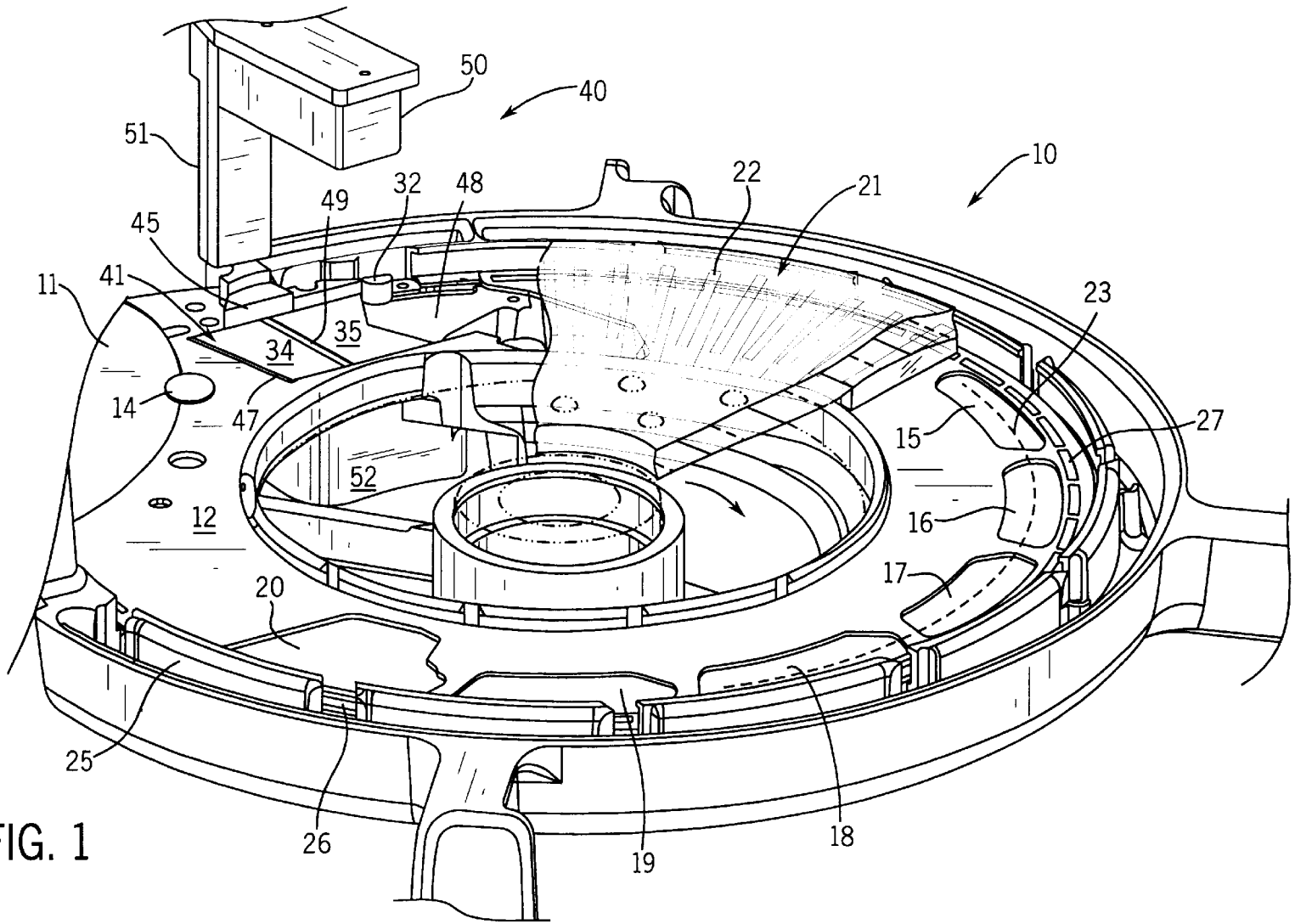
FIG. 1 is a perspective view of a portion of the coin sorter incorporating the present invention.

Referring to FIG. 1, the coin handling machine 10 is a sorter of the type shown and described in Zwieg et al., U.S. Pat. No. 5,992,602, and previously offered under the trade designation, "Mach 12" and "Mach 6" by the assignee of the present invention. This type of sorter 10, sometimes referred to as a FIG. 8 type sorter, has two interrelated rotating disks, a first disk operating as a queueing disk 11 to separate the coins from an initial mass of coins and arrange them in a single file of coins 14 to be fed to a sorting disk assembly. The queueing disk 11 can be operated to feed coins up to a rate of 4500 coins per minute.

Figure 2:
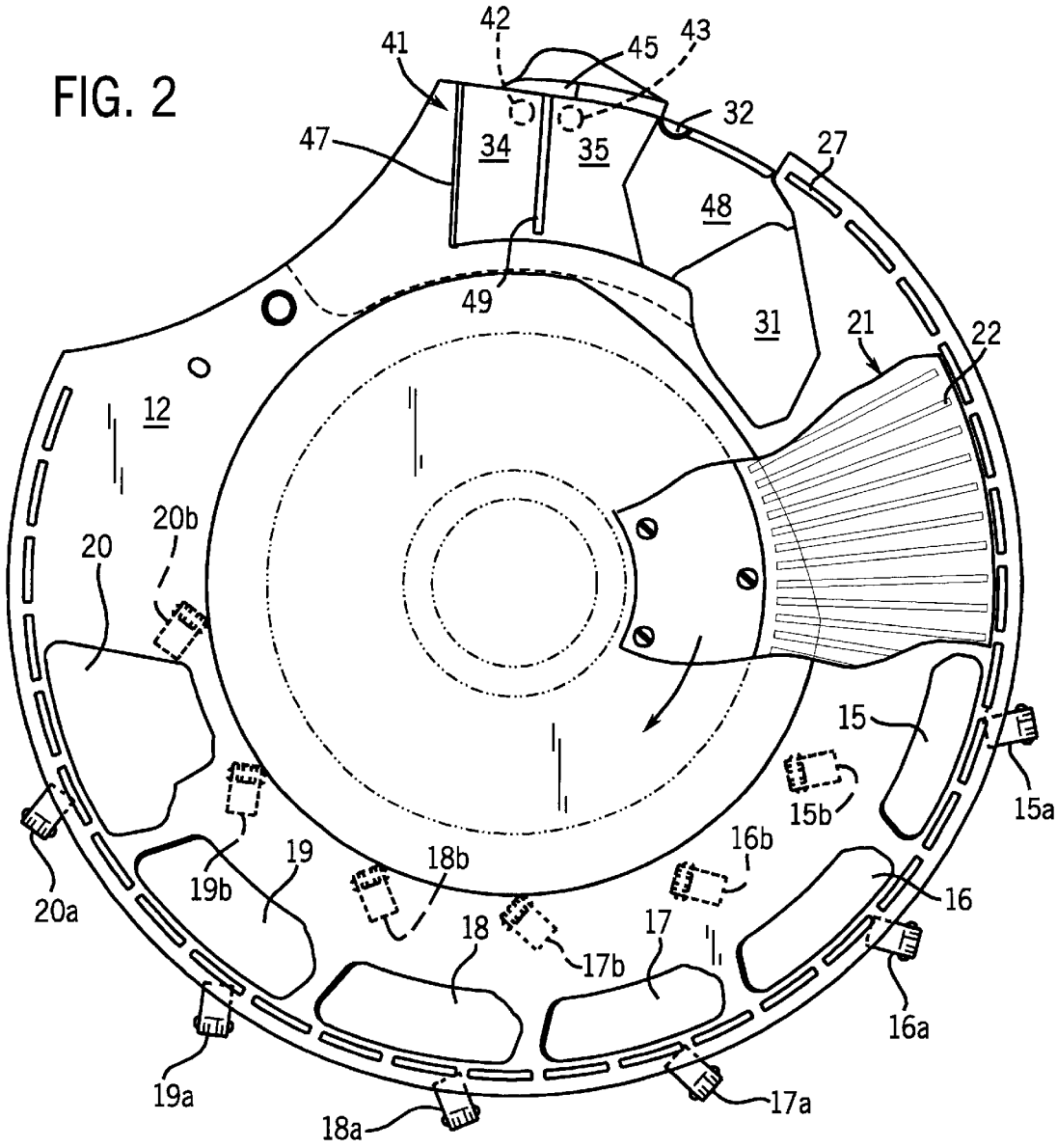
FIG. 2 is top plan view of a sorter plate in the coin sorter of FIG. 1.

A sorting disk assembly has a lower sorter plate 12 with coin sensor station 40, an offsort opening 31 (see FIG. 2) and a plurality of sorting apertures 15, 16, 17, 18, 19 and 20. There may be as many as ten sorting apertures, but only six are illustrated for this embodiment. The first five sorting apertures are provided for handling U.S. denominations of penny, nickel, dime, quarter and dollar. The sixth sorting opening can be arranged to handle half dollar coins or used to offsort all coins not sorted through the first five apertures. In some embodiments as many as nine sizes can be accommodated. It should be noted that although only six sizes are shown, the sorter may be required to handle coins with twice the number of alloy specifications. For example, the alloy content of U.S. pennies, nickels, dimes, quarters and half dollars is a different alloy content today than prior to 1965, when there was a change in the alloy content of the U.S. coin set. The machine 10 and it electronic controls are constructed to detect and identify pre-1965 U.S. coins as well as U.S. coins minted in 1965 and thereafter, including up to eighteen coin denomination-alloy specifications. The machine also is adapted to count and sort the coins of Europe, which typically comprise a coin set with more coins that the U.S. coin set.

As used herein, the term "apertures" shall refer to the specific sorting openings shown in the drawings. The term "sorting opening" shall be understood to not only include the apertures, but also sorting grooves, channels and exits seen in the prior art.

The sorting disk assembly also includes an upper, rotatable, coin moving member 21 with a plurality of webs 22 or fingers which push the coins along a coin sorting path 23 over the sorting apertures 15, 16, 17, 18, 19 and 20. The coin moving member is a disk, which along with the webs 22, is made of a light transmissive material, such as acrylic. The coin driving disk may be clear or transparent, or it may be milky in color and translucent.

The webs 22 are described in more detail in Adams et al., U.S. Pat. No. 5,525,104, issued Jun. 11, 1996. Briefly, they are aligned along radii of the coin moving member 21, and have a length equal to about the last 30% of the radius from the center of the circular coin moving member 21.

A rail formed by a thin, flexible strip of metal (not shown) is installed in slots 27 to act as a reference edge against which the coins are aligned in a single file for movement along the coin sorting path 23. As the coins are moved clockwise along the coin sorting path 23 by the webs or fingers 22, the coins drop through the sorting apertures 15, 16, 17, 18, 19 and 20. according to size, with the smallest size coin dropping through the first aperture 15. As they drop through the sorting apertures, the coins are sensed by optical sensors in the form of light emitting diodes (LEDs) 15*a*, 16*a*, 17*a*, 18*a*, 19*a* and 20*a* (FIG. 2) and optical detectors 15*b*, 16*b*, 17*b*, 18*b*, 19*b* and 20*b* (FIG. 2) in the form of phototransistors, one emitter and detector per aperture. The photo emitters 15*a*, 16*a*, 17*a*, 18*a*, 19*a* and 20*a* are mounted outside the barriers 25 seen in FIG. 1 and are aimed to transmit a beam through spaces 26 between the barriers 25 and an angle from a radius of the sorting plate 21, so as to direct a beam from one corner of each aperture 15, 16, 17, 18, 19 and 20 to an opposite corner where the optical detectors 15*b*, 16*b*, 17*b*, 18*b*, 19*b* and 20*b* (FIG. 2) are positioned.

As coins come into the sorting disk assembly 11, they first pass a coin sensor station 40 (FIG. 1). In the prior art, this station 40 was used to detect coin denominations using an inductive sensor, as well as to detect invalid coins. Invalid coins were then off-sorted through an offsort opening 31 with the assistance of a solenoid-driven coin ejector mechanism 32 (FIGS. 1, 2 and 7) having a shaft with a semicircular section having a flat on one side, which when rotated to the semicircular side, directs a coin to an offsort edge 36 and ultimately to offsort opening 31. This offsorting of coins occurs in the same place, however, the present embodiment utilizes a different type of coin sensing at coin sensor station 40.

In the present invention, optical imaging is used to identify coins by size, and this data can be used alone for identifying coins by denomination and for certain operations such as bag stopping. With the addition of inductive sensors for sensing such things as alloy content, the control becomes more sophisticated in not counting coins which may have the proper size, but otherwise do not meet the coin denomination-alloy specifications.

Figure 5A:
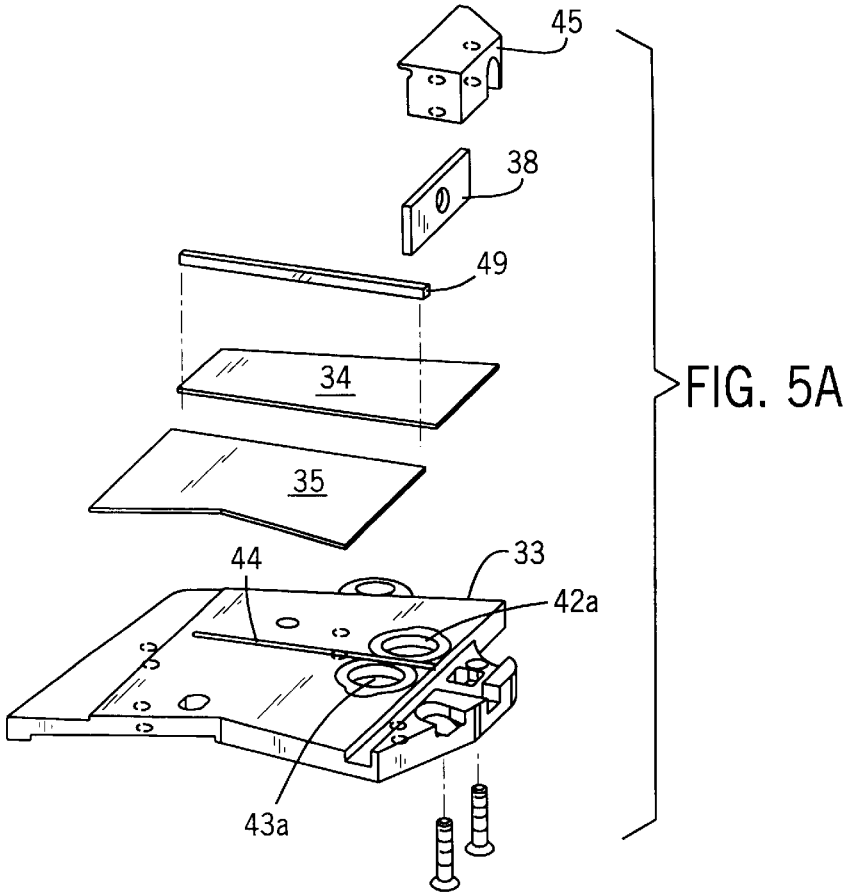
FIG. 5A is an exploded detail view of a first embodiment of the sensor assembly of FIGS. 1 and 3.

Next, the structural details of the coin sensor will be described. The coin sensor station 40 includes a coin path insert 41. This coin path insert 41 is preferably an assembly having an upper surface component made of a nonmagnetic material, for example, a zirconia ceramic, so as not to interfere with inductive sensors to be described. The use of zirconia overcame a problem of absorption of metal by the coin path insert when other ceramics, such as alumina were used. As illustrated for a first embodiment in FIG. 5A, the insert 41 has an aluminum base plate 33 and upper surface pieces 34, 35 of zirconia ceramic. Also seen in FIG. 5A are apertures 42*a*, 42*b* for positioning the sensors 42 and 43. In a second embodiment, illustrated in FIG. 5B, the upper surface of the coin path insert is provided by an integral, transparent sapphire window element 37 that covers base plate 33.

Figure 5B:
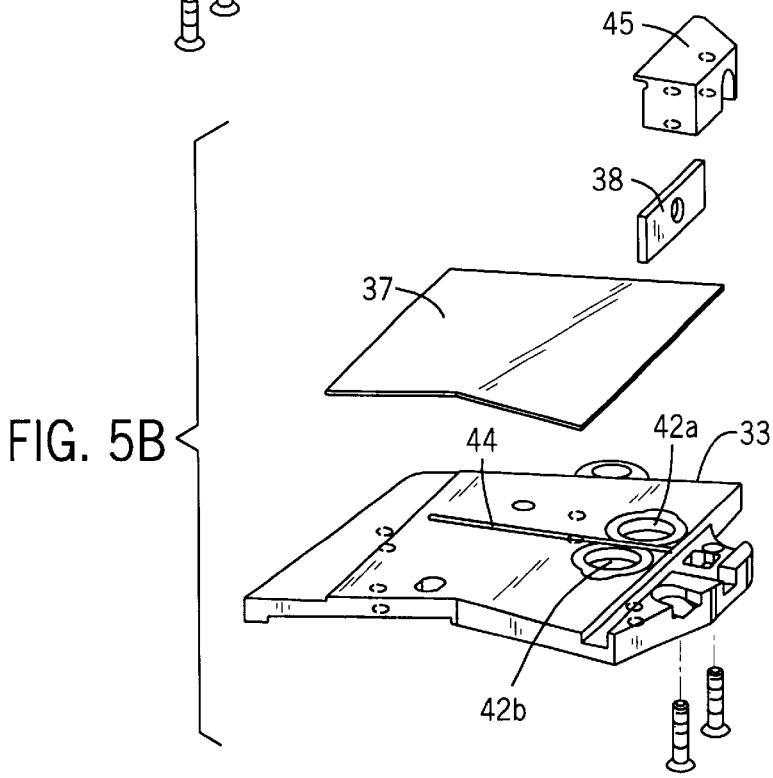
FIG. 5B is an exploded detail view of a second embodiment of the sensor assembly of FIGS. 1 and 3.

The insert houses two inductive sensors 42, 43 (shown in phantom in FIGS. 2, 6A and 6B), which are inserted from the bottom into apertures 42*a*, 43*a* (FIGS. 5A and 5B). One sensor 42 is for sensing the alloy content of the core of the coin, and another sensor 43 is for sensing the alloy content of the surface of the coin. This is especially useful for coins of bimetal clad construction. The two inductive sensors 42, 43 are inserted on opposite sides of a radially aligned slit 44, which is used for the optical image detector to be described. The slit 44 is preferably filled or covered by a light transmissive, sapphire window element 49.

The coin path insert 41 is disposed next to a curved rail (not shown) which along with edge sensor housing 45 (FIG. 1) forms a reference edge for guiding the coins along the coin path. An edge thickness/alloy inductive sensor 46 (FIG. 2) is positioned in the edge sensor housing 45 so as not to physically project into the coin path. A small piece of zirconia ceramic 38 (FIGS. 5A and 5B) is mounted on a face of the housing 45 facing the coin path to be contacted by the edges of the coins as they pass.

Referring to FIG. 1, the coin path insert 41 has an edge 47 on one end facing toward the queueing disk, and a sloping surface 48 at an opposite end leading to the offsort opening 31.

A housing shroud 50 (FIG. 1) is positioned over the window element 49, and this shroud 50 contains an optical source provided by a staggered array of light emitting diodes (LED's) 54 (FIG. 6A) for beaming down on the coin path insert 41 and illuminating the edges of the coins 14 as they pass by (the coins themselves block the optical waves from passing through). A krypton lamp can be inserted among the LED's to provide suitable light waves in the infrared range of frequencies. The optical waves generated by the light source may be in the visible spectrum or outside the visible spectrum, such as in the infrared spectrum. In any event, the terms "light" and "optical waves" shall be understood to cover both visible and invisible optical waves.

The housing cover 50 is supported by an upright post member 51 of rectangular cross section. The post member 51 is positioned just outside the coin sorting path 23, so as to allow the elongated optical source 54 to extend across the coin sorting path 23 and to be positioned directly above the elongated slit 44 and window 49.

Figure 3:
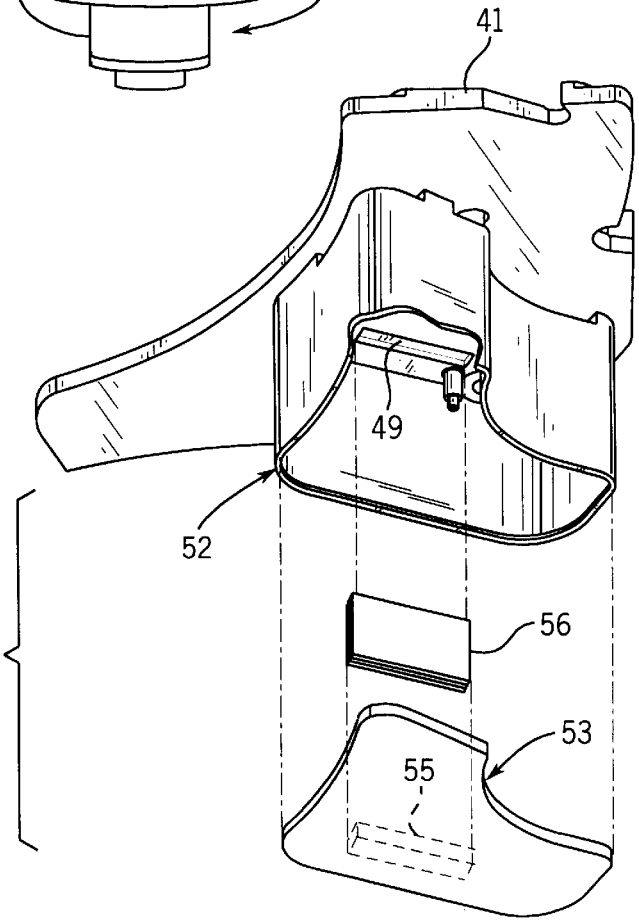
FIG. 3 in an exploded detail view of the optical sensor assembly in the coin sorter of FIG. 1.

Underneath the coin path insert 41 is a housing 52 (FIG. 1) of aluminum material for containing a coin sensing module 53 (FIG. 3). As used herein, the term "circuit module" shall refer to the combination of circuit packages and the electronic circuit board upon which the circuit packages are mounted to form an electronic circuit. As seen in FIG. 3, the housing 52 has a body, with a body cavity, and a cover (not shown) enclosing the body cavity. The cover is of the same shape as the entrance to the body cavity of housing 52.

The circuit module 53 supports a linear array 55 of photodetector diodes, such that when the circuit module 53 is positioned properly in the housing 52 (FIG. 3) (the shape of the circuit module 53 is keyed to the shape of the housing 52), the linear optical detector array 55 will be positioned below the slit 44 and the window 49. A linear lens array 56 is disposed between the window 49 and the optical detector array 55 to transmit the light from the slit 49 to the optical detector array 55, and also to diffuse concentrations of light from the LEDs 54, if necessary. The optical detector array 55 is preferably a TSL 1406 768x1 pixel array available from TAOS of Plano, Tex., USA. The lens array is preferably a Selfloc Lens Array Model 20A available from NSG.

Figure 4:
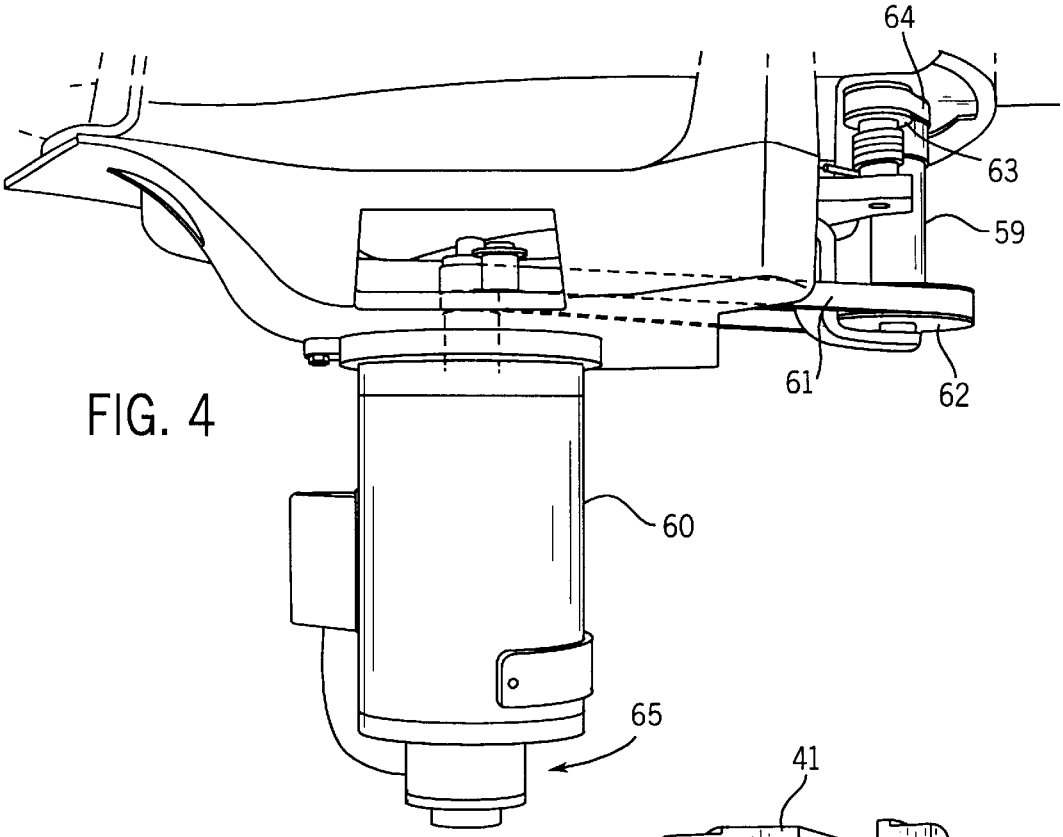
FIG. 4 is a side view in elevation of a bottom portion of the coin sorter of FIG. 1 showing a motor and a brake.

FIG. 4 shows a DC electric motor 60 for driving the two moving disks in the coin sorter 10. The motor 60 is connected through a belt 61 to a rotatable transfer shaft 59 with one pulley 62 being driven by belt 61 and a second pulley 63 for transferring power to a second belt 64 directly driving coin moving member 21 and the driving member 11 in the queueing portion of the machine 10. An electromechanical brake 65 is mounted to the bottom of the motor 60. The brake 65 is used for stops when a predetermined coin count has been reached and for emergency stops. The data from the optical imaging sensor is used for purposes of counting coins to reach the predetermined coin counts, known as bag stop limits.

Figure 6A:
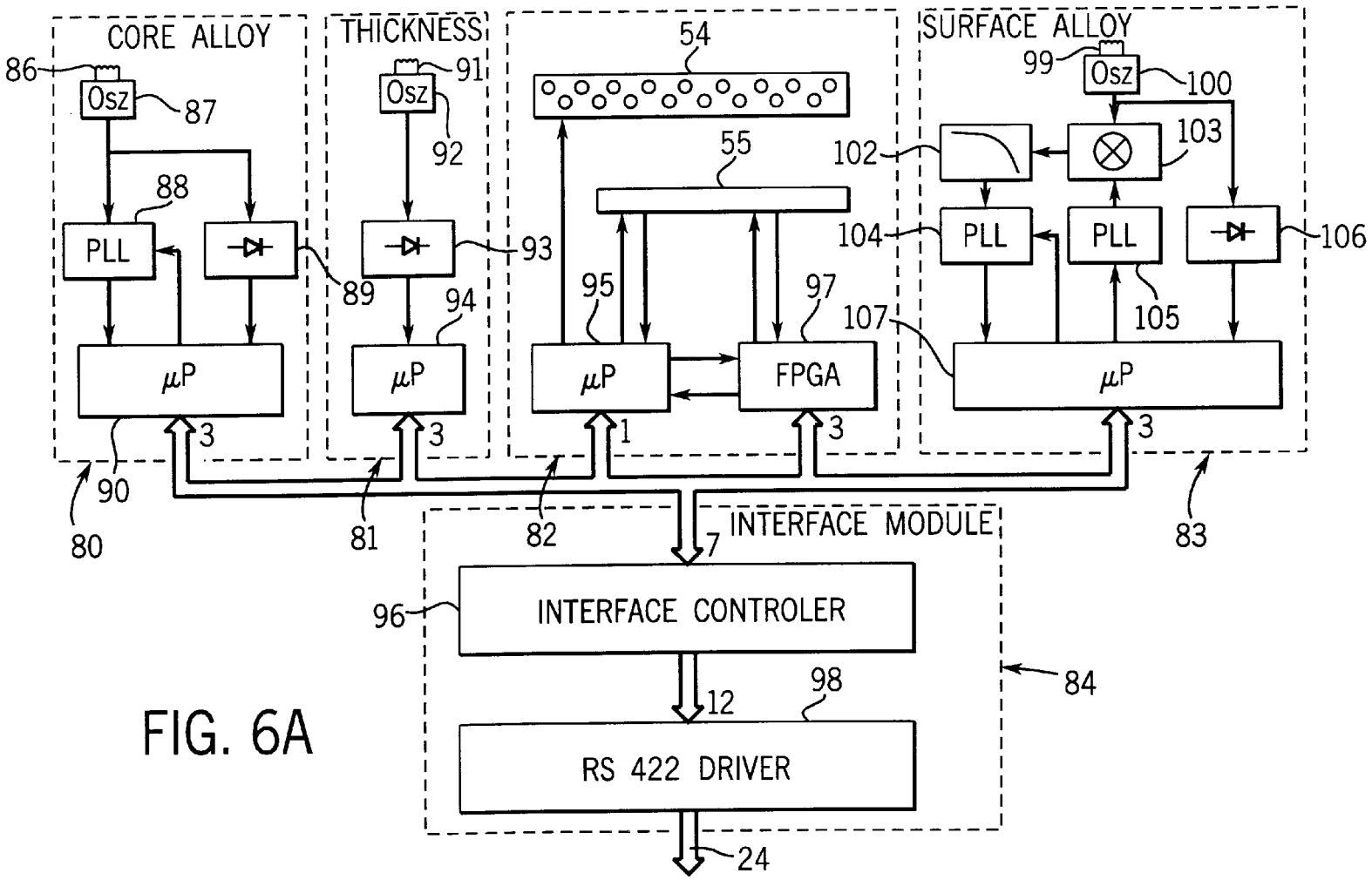
FIG. 6A is a block diagram of the sensor circuit module seen in FIG. 3.

FIG. 6A shows the details of a sensor circuit module 53 including five (5) sub-modules 80, 81, 82, 83 and 84 each utilizing an embedded microcontroller.

A core alloy detector sub-module 80 utilizes a 9.3 mm sensing coil 86 embedded in the sensor 42 and coupled to an oscillator 87 operating at 180 kHz. As a coin enters the field of the coil 86, the oscillator impedance is altered by the eddy currents developed in the coin, resulting in both frequency and voltage changes. The frequency is measured by a phase locked loop (PLL) circuit 88 acting as a frequency-to-voltage converter. The phase locked loop circuit responds very quickly to frequency changes. The voltage of the oscillator is measured by rectifying the sine wave through rectifier circuit 89 and reading it with an analog-to-digital (A/D) converter integrated with a microcontroller 90. The microcontroller is preferably a PIC 16C715 microcontroller available from Microchip Technology, Inc., Chandler, Ariz., USA. The reading of the coin alloy data occurs when the coin fully covers the sensor coil 86 as determined by a sensor trigger point 57, illustrated in FIG. 6B. Therefore, the reading is taken relative to a specific position in the coin path 23. Values for the voltage and frequency are transferred to the coin sensor module interface controller 84.

The trigger point 57 is arranged a predetermined distance, such as 4 mm, from the edge provided by elements 38, 45. This has been determined to correspond to the desired distance inward from the leading and trailing edges at which the core alloy and surface alloy data, respectively, are sampled.

A thickness/edge alloy detector sub-module 81 (FIG. 6A) provides a single data output as a function of both coin thickness and alloy composition. A 3.3 mm sensing coil 91 is mounted in sensor 46 in the side rail 45 (FIG. 1) along the coin path 23 with the active field perpendicular to the core alloy detector 42. The sensor coil 91 (FIG. 6A) oscillates at 640 kHz as provided by oscillator 92. As a coin to be tested approaches (FIG. 6B), the presence of the coin material changes the impedance of the oscillator 92. The output of the oscillator 92 is rectified by a diode rectifier circuit 93 and sampled many times by an analog-to-digital converter integrated into a second microcontroller 94, which may be of the same type as microcontroller 90. When the maximum influence (lowest output) of a coin is determined, the value is transmitted to coin sensor module interface controller 84.

An optical coin size sensor module 82 is controlled by a microcontroller 95, similar to microcontrollers 90 and 94. The illumination source, comprised of multiple LED's 54 in a staggered pattern (FIG. 6A), illuminates the coin sensing area with light energy which in turn is detected by the lineal optical detector array 55, which provides a 768x1 pixel array below the coin path insert 41. The light waves are emitted through the light transmissive drive member 21, and the sapphire window 49 flush with the coin path insert 41. A dual comparator method is used to differentiate between the gradual transition of webs 22 on the drive member 21 and the abrupt transition of the coin edge. This method is carried out in FPGA 97. By recognizing the abruptness of the transitions for a coin edge in comparison with the effects of a web 22 of the rotatable member 21, the logic in the FPGA 97 separates the data generated by the webs 22 of the coin moving member 21 from the size data for a detected coin.

Figure 6B:
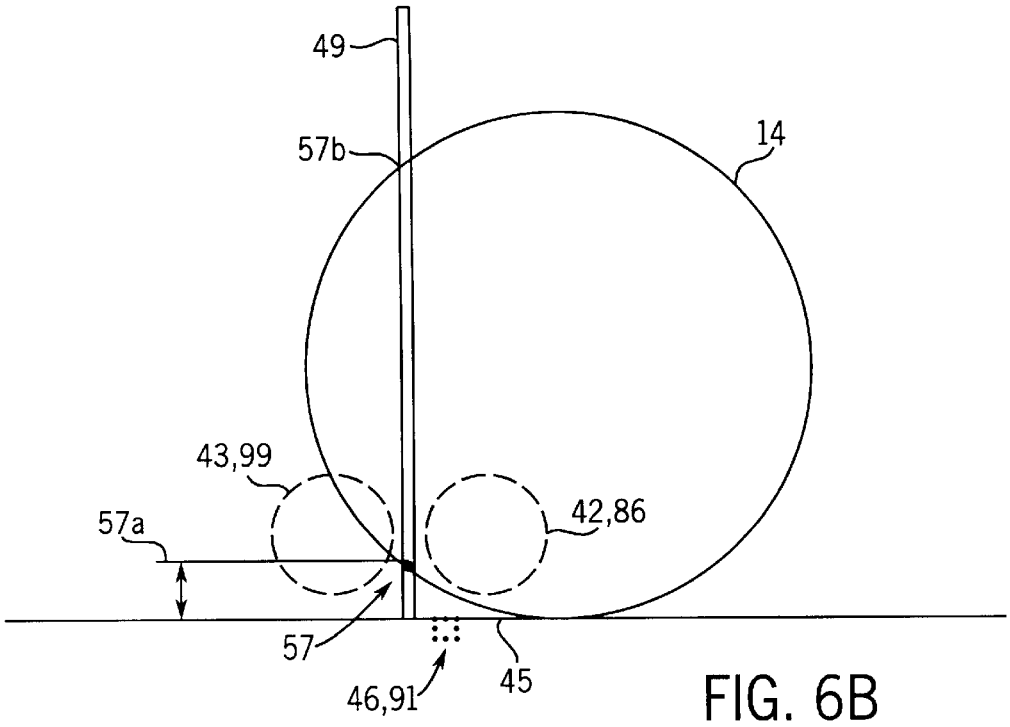
FIGS. 6B and 6C are enlarged detail diagrams of a coin passing through the sensor assembly of FIG. 3.

When the leading edge of a coin 14 first covers a portion of the linear detection array 55, readings will taken between a first light-to-dark transition 57*a* and a first dark-to-light transition 57*b* (FIG. 6B). As the coin moves through the sensor, readings will be taken between other light-to-dark transitions such as 58*a* and other dark-to-light transitions such as 58*b* seen in FIG. 6C. Size readings are taken every 400 microseconds to get the most samples possible. The value halfway between the points 57*a*, 57*b*, or 58*a*, 58*b* is determined as the radius of the coin. A separate radius is calculated every 400 microseconds. An average radius is calculated by microelectronic CPU 95 and is transmitted to interface controller CPU 96 for transmission to controller 110. The multiple samples minimize the effect of nicked or non-round edges.

Referring to FIG. 6A, a microcontroller CPU 95 reads imaging data from a field programmable gate array (FPGA) 97, which connects to the (number of elements) photodiode array 55 through the CPU 96. The FPGA 97 receives and interprets pixel imaging signals from the photodiode array 55 which are then read by the microcontroller CPU 95, and used to calculate the size of each coin as it passes the window 49. The use of the hardware-logic FPGA 97 allows the data to be processed at a rate sufficient for the machine to identify 4500 coins per minute.

The photodiode array 55 does not necessarily span the full diameter of each coin, and an offset may be used to calculate the full diameter. While radius data is used in this embodiment, it should be apparent that diameter data is an equivalent, being the radius multiplied by two. The term "dimension" or "size" in relation to coins shall include radius, diameter and other dimensions from which coin size can be derived. The coin size data is then communicated to the second microcontroller CPU 96.

Figure 6C:
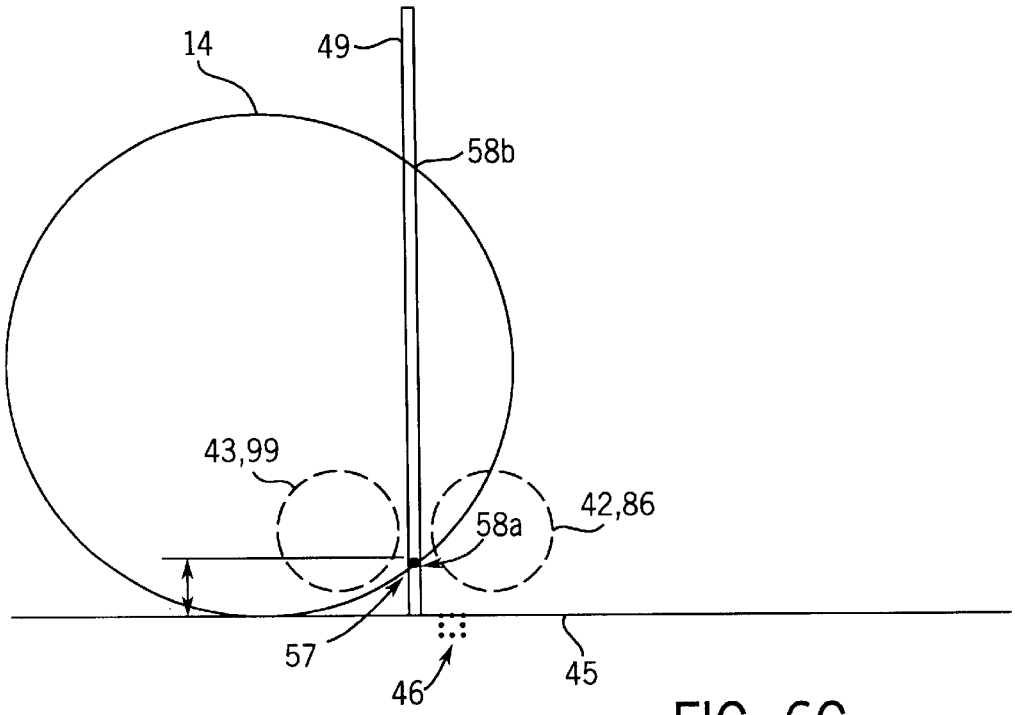

Referring to FIG. 6A, a surface alloy detector submodule 83 includes a 9.3 mm sensing coil 99, which oscillates at a nominal frequency of 1 MHz as provided by oscillator 100. Two phase-locked-loop (PLL) devices 104, 105 are used, one to reduce the frequency, the other to measure the frequency. A summing circuit 103 and a fourth order filter 102 are used in one of the loops. A voltage representing a magnitude of the sensed signal is obtained by rectifying the sine wave with diode rectifier circuit 106 and reading the result with an analog-to-digital converter included in a microcontroller 107. This microcontroller is a PIC 16C72 microcontroller available from Microchip Technology, Inc., of Chandler, Ariz., USA. The reading of the coin alloy data occurs when the coin fully covers the sensor 43 and sensor coil 99 as determined by the sensor trigger point 57 (FIG. 6C). Therefore, the reading is taken relative to a specific position in the coin path 23. Values for the voltage and frequency are then transferred to an interface controller module 84 for the sensor module 53.

Figure 7:
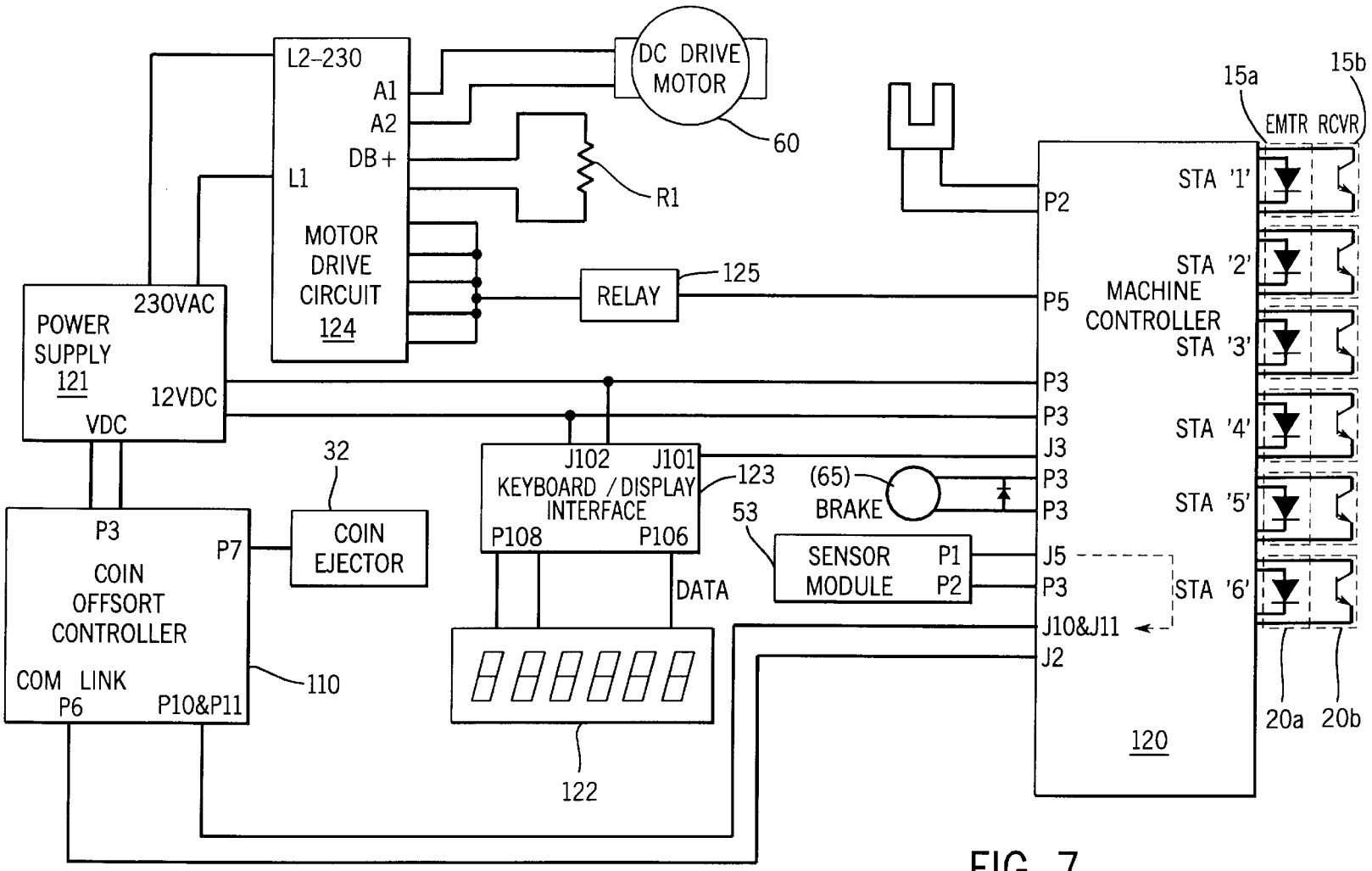
FIG. 7 is a schematic of the overall electrical control system of the sorter of FIG. 1.

The interface controller module 84, includes a microcontroller CPU 96 for reading the core voltage, core frequency, thickness, size, surface voltage and surface frequency data from the other detector modules 80, 81, 82 and 83 and transmitting the data to the coin offsort controller module 110 in FIG. 7. The interface controller 96 is preferably a PIC 16C72 microcontroller circuit available from Microchip Technology, Inc., of Chandler, Ariz., USA. Other suitable CPU microcontrollers may be used for the microcontrollers described above in the submodules 80–84. The interface microcontroller CPU 96 connects to a coin offsort controller module 110 (FIG. 7) through an interrupt request line (IRQ), a three-bit address bus, an eight-bit data bus and a set of line drivers 98.

Figure 6D:
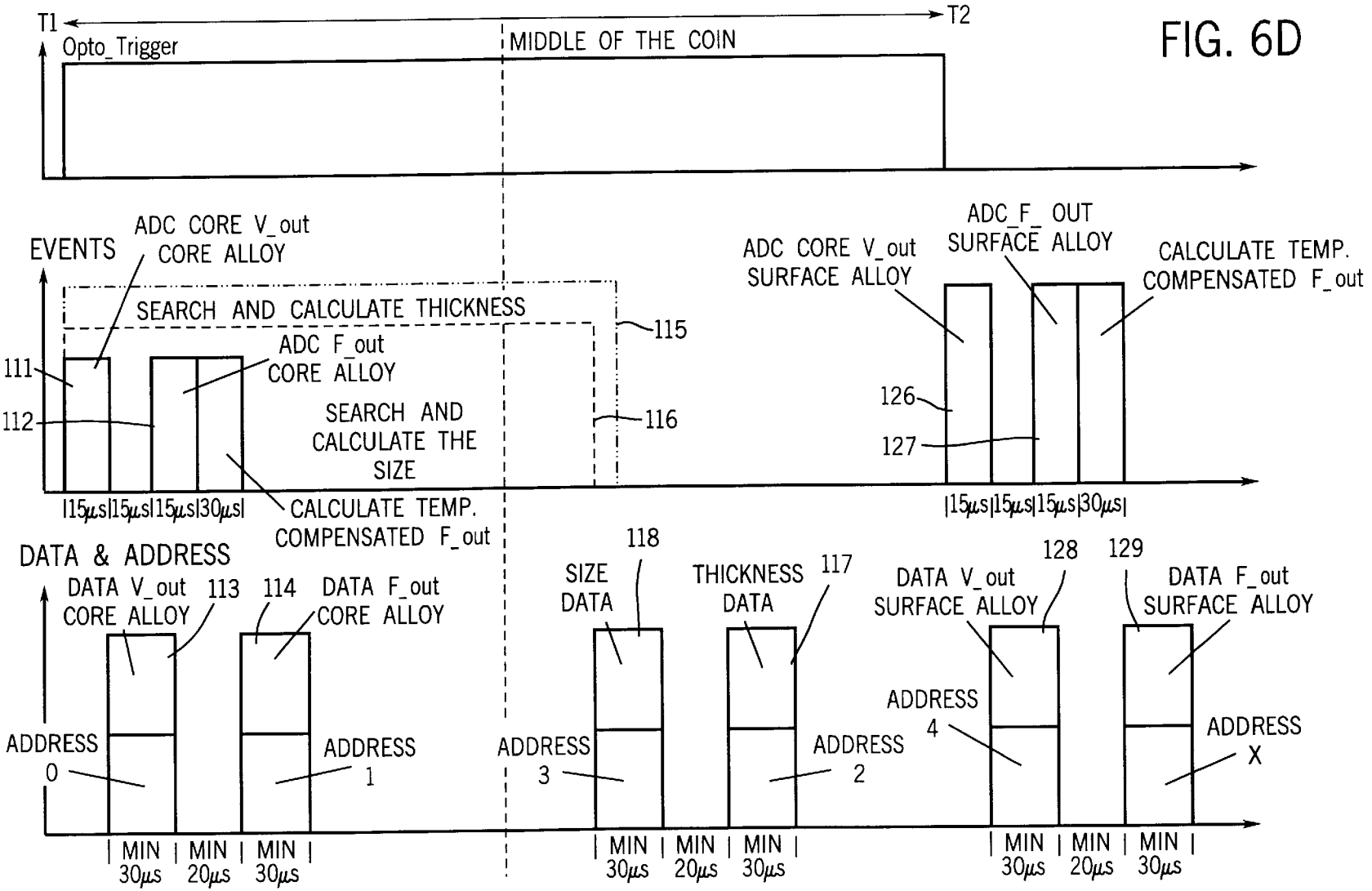
FIG. 6D is a timing diagram of the operation of the sensor circuit module of FIG. 6A.

The manner in which the interface controller 96 reads data from the sub-modules 80, 81, 82 and 83 is illustrated in the timing diagram of FIG. 6D. First, the data for magnitude and frequency from the core alloy sensor 42 is read into sub-module 80 in 15-microsecond intervals 111, 112 beginning at trigger point 57 in FIGS. 6B and 6C (T1 in FIG. 6D). Then, the data from the core alloy sensor 42 is read by the interface controller 96 in 30-microsecond intervals 113, 114, separated by a 20-microsecond interval. Also, the data from the edge alloy thickness sensor 46 is read into sub-module 81 in interval 115, and then the coin passes over the imaging sensor 54, 55, such that size readings are read by sub-module 82 and the size is calculated in time frame 116. The interface controller 96 then reads in the data for coin thickness and coin size in time frames 117, 118. The order of these two quantities, coin thickness data and coin size data, could be reversed between themselves, but would still follow the core alloy sensing data. Lastly, as the coin passes the surface alloy sensor and the trigger point 57 in FIGS. 6B and 6C (T2 in FIG. 6D), sub-module 83 reads in surface alloy voltage and frequency data in 15-microsecond intervals 126, 127. The interface controller 96 reads the surface alloy data for magnitude and frequency in 30-microsecond intervals 128, 129, separated by a 20-microsecond interval.

In one embodiment of the present invention, the sensors 42, 43 and 46 for checking coins for offsorting purposes are not used. Only the photodiode array 55 for detecting the size of each coin is used for sensing coins passing the coin path insert 41. In this simplified embodiment, a coin discriminator/offsort controller module 110 (FIG. 7) is not necessary, and the data from the coin sensor module 53 is transmitted directly to a main machine controller CPU module 120 seen in FIG. 7 through a three-bit address bus and an eight-bit data bus and a set of line drivers, designated as Port 2. In the embodiment in which the sensors 42, 43 and 46 are used in the sensor module 53, the coin sensor module 53 communicates through Port 1 (P1) and a feed-through connection on the main controller CPU 120 (J10–J11 connecting to P10–P11) to the coin offsort controller module 110.

Referring to FIG. 7, the machine controller CPU 120 has six I/O ports (STA 1–STA 6) for sending output signals to the light emitting diodes 15*a*, 16*a*, 17*a*, 18*a*, 19*a* and 20*a* and receiving signals from the optical detectors 15*b*, 16*b*, 17*b*, 18*b*, 19*b* and 20*b* for the six sorting apertures. The main controller CPU 120 thereby detects when coins fall through each sorting aperture 15–20 and can maintain a count of these coins for totalizing purposes. By "totalizing" is meant the counting of coin quantities and monetary value for purposes of informing a user through a display, such as a graphic, liquid crystal display (LCD) 122, which is interfaced with a keyboard through interface 123 to the main controller CPU 120.

The main controller CPU 120 is interfaced through electronic circuits to control the DC drive motor 60. In particular, the main controller CPU 120 is connected to operate a relay 125 which provides an input to an electronic motor drive circuit 124. This circuit 124 is of a type known in the art for providing power electronics for controlling the DC motor 60. This circuit 124 receives AC line power from a power supply circuit 121. The motor drive circuit 124 is also connected to a dynamic braking resistor R1 to provide dynamic electrical braking for the DC motor 60.

The coin discriminator/offsort controller module 110 includes a processor, such as a Philips P51XA microelectronic CPU, as well as the typical read only memory, RAM memory, address decoding circuitry and communication interface circuitry to communicate with the sensor control module 53 and the main controller CPU 120 as shown in FIG. 7. The coin discriminator/offsort controller module 110 is connected to operate the coin ejector mechanism 32, when a coin is determined to be outside all of the coin specifications based on data received from the coin sensing station 40.

Figure 8:
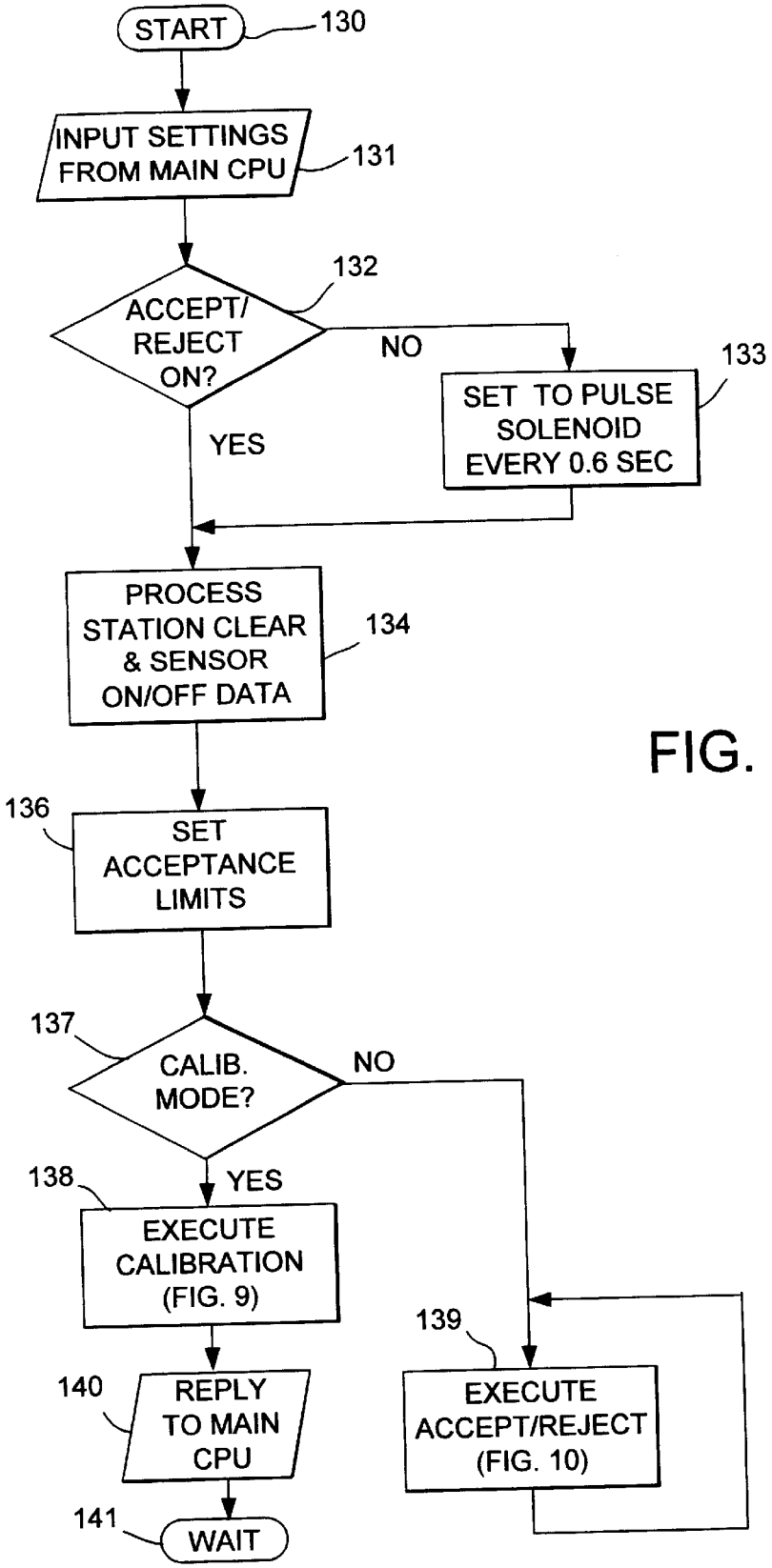
FIGS. 8–10 are flow charts of operations of the coin discriminator/offsort controller.

Referring next to FIG. 8, a main loop, startup routine for the operation of the coin discriminator/offsort processor in module 110 is charted. The operations are carried out under program instructions. The start of this portion of the operations is represented by the start block 130. Next, as represented by input block 131, the coin discriminator/offsort processor communicates with the main controller CPU 120 to read in operator settings, which are entered through a user interface for the coin sorter 10. These settings include sensitivity settings for eighteen stations or alloy specifications, with four sensors per station (size, thickness, surface alloy and core alloy) for a total of seventy-two with plus and minus settings for a grand total of one hundred and forty-four (144) items of data. In other embodiments of the invention, the number of coin-alloy specifications may be expanded to thirty-six.

Then, as represented by decision block 132, a check is made to see if accept/reject mode has been selected to be "ON". If the coin detection mechanism is "off", as represented by the "NO" branch, the coin discriminator/offsort processor sends a signal to the offsort solenoid every 0.6 seconds to place it in the accept position for all coins passing by. In this position, the rounded portion is turned away from the coin path and flat portion is turned to face the coin path. The set up for this operation is represented by process block 133. Otherwise, if the answer is "YES" and the coin detection is "ON," then the coin discriminator/offsort processor proceeds to perform the coin acceptance process after some other setup operations to be described. As represented by process block 134, a matrix of data representing the eighteen (18) stations (coin denomination/alloy specifications) with four sensors each is checked to see if any station has been cleared during the calibration routine, meaning that it is not in use as represented by zeroes in its four sensor data locations in the matrix. Also, each sensor is checked within each station to see if it should be "ON" or "OFF".

Then, the coin discriminator/offsort processor executes instructions represented by process block 136 to set up acceptance test limits for each coin denomination/alloy specification for each sensor that is "ON", including size, surface alloy, core alloy and edge thickness. This allows the operator to adjust coin sensitivity without changing original calibration values.

Where a parameter, such as coin size or edge thickness has a single value, limits can be set up by using the sensitivity settings to determine a range plus (+) and minus (−) from a single average value calculated for a specific coin denomination and alloy specification based on a thirty-coin sample run. In the case of two-variable parameters, represented by core alloy composition and surface alloy composition, a "least squares" method is used to fit a curve to the two-dimensional plot of data points for a calibration run of 32 coins. The curve has a slope, A, an axis-intercept B, and a Δ factor according to the following equations:

$$A=(n*\Sigma x*y-(\Sigma x)*(\Sigma y))/\Delta \quad 1)$$

$$B=((\Sigma x*x)*(\Sigma y)-(\Sigma x)*(\Sigma x*y))/\Delta \quad 2)$$

$$\Delta=n*\Sigma x*x-(\Sigma x)^2 \quad 3)$$

When thirty-two readings of voltage and frequency for a surface alloy, for example, are plotted on an x-y graph, it produces a field of points. Using the above equations, a curve is determined for use as baseline for calculating a lower acceptance limit and an upper acceptance limit. The acceptance test limits in the y-direction become a range of values above and below this curve based on the sensitivity settings entered by the operator and read in input block 131. The acceptance test limits in the x-direction are limited by the end points of the curve.

Figure 9:
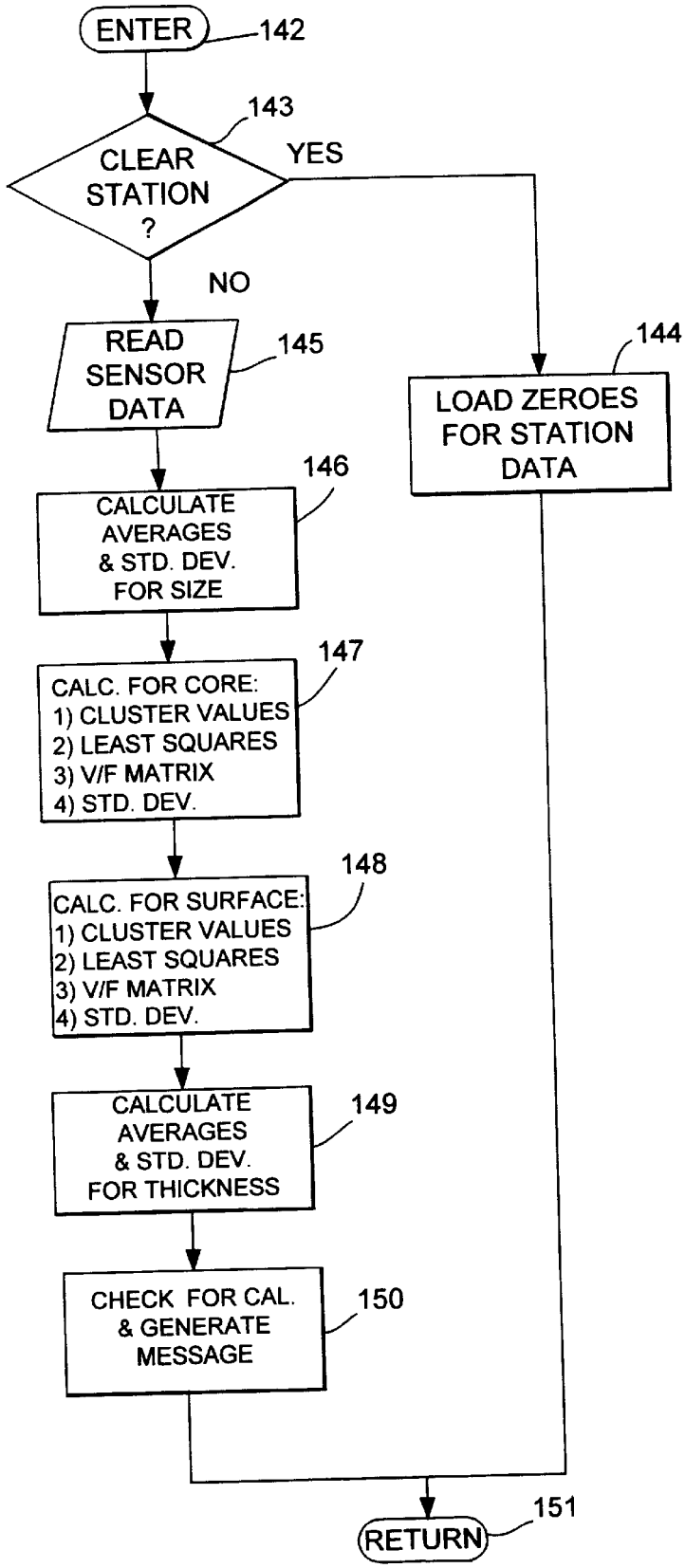
Figure 10:
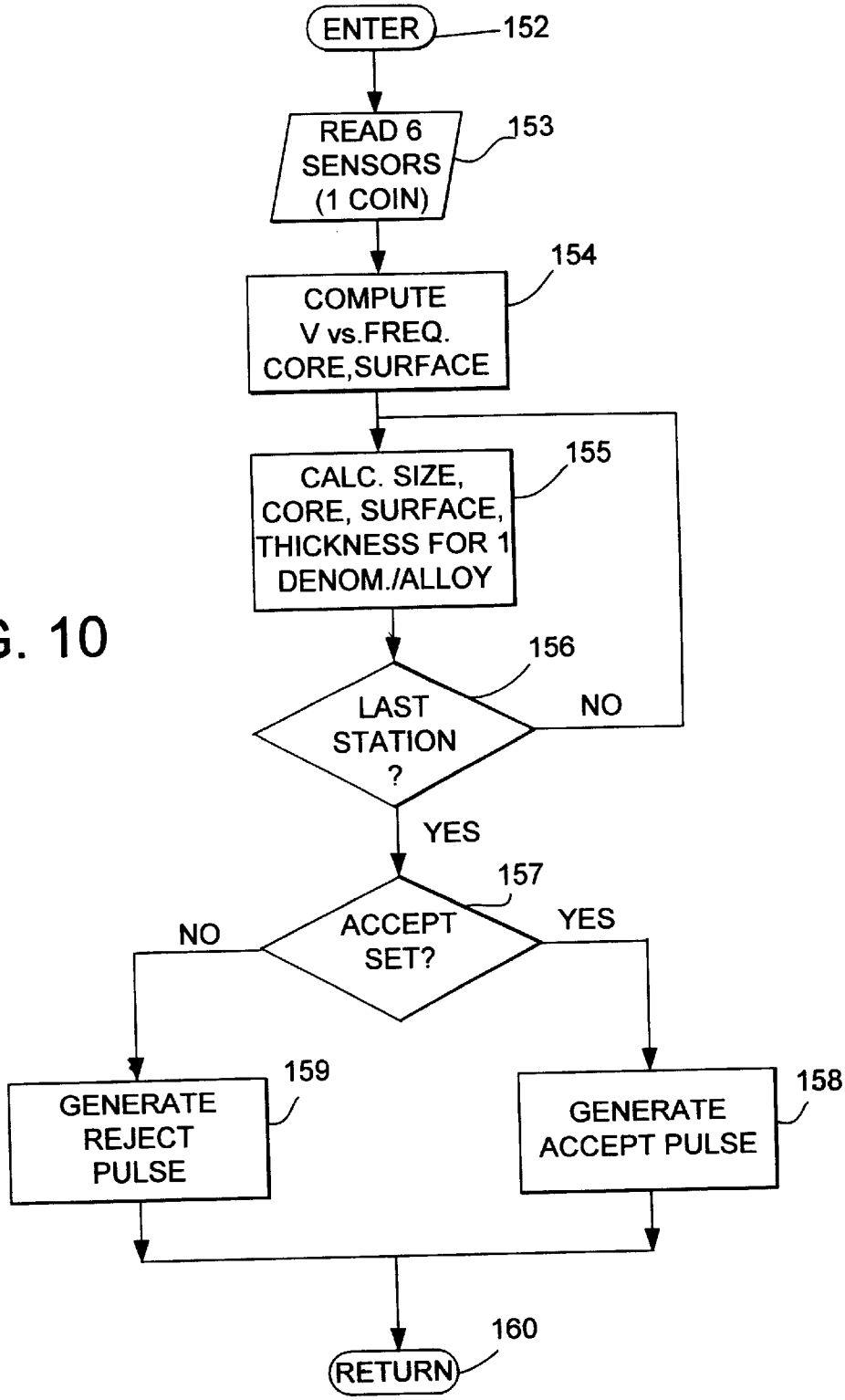

After the acceptance test limits are set for up to eighteen denomination/alloy specifications, instructions are executed as represented by decision block 137 to determine whether the calibration mode has been selected. If the answer is "YES", the calibration routine represented by process block 138 and FIG. 9 is executed. If the answer is "NO", the accept/reject routine represented by process block 139 and FIG. 10 is executed. After block 138 is executed, the coin discriminator/offsort processor replies with data to the main CPU 120, as represented by process block 140, and enters a wait mode, until signaled by the main CPU 120, as represented by end block 141. When block 139 is executed, the processor will continue to loop through that routine until a reset is received from the coin offsort controller 110 indicating a mode change input from a human operator.

Referring next to FIG. 9, assuming that the calibration mode has been selected in decision block 138, the coin discriminator/offsort processor enters a calibration routine as represented by start block 142 in FIG. 9. The processor then executes program instructions represented by decision block 143 to determine if calibration data should be cleared for any denomination/alloy specification. If the result of this decision is "YES" then the coin discriminator/offsort processor executes program instructions represented by process block 144 to zero out all data for coin size, thickness, core alloy composition and surface alloy composition. This will be done for any of the eighteen coin specifications which have not been selected. The processor will the exit the calibration routine. If the result of this decision is "NO" then the coin discriminator/offsort processor executes program instructions represented by process block 145 to read data for 32 coins for each denomination and each selected denomination/alloy specification from the sensor module 53 (FIGS. 6A and 7).

As represented by process block 146, the coin discriminator/offsort processor then calculates the average value for thirty-two (32) coins for the single-dimension value of coin size. Next, it proceeds as represented by process block 147 to calculate a cluster of thirty-two values received from the "core alloy" sensor. Because this sensor generates data for both voltage magnitude and frequency, a "least squares" method is used to fit a curve to the two-dimensional plot of data points. The curve has a slope, A, an axis-intercept, B, and a Δ factor as described by equations 1), 2) and 3) mentioned above.

When thirty-two readings of voltage and frequency for a "surface alloy," for example, are plotted on an x-y graph, it produces a field of points. Using the above equations, a curve is determined for use as baseline for calculating a lower acceptance limit and an upper acceptance limit. To provide a better set of data for use with the least squares algorithm, a clustered values algorithm is also applied to the data. The resulting data for each denomination/alloy specification is stored in single data structure to provide faster execution during coin detection operations.

The above procedure for core alloy composition is also applied to data for surface alloy composition based on a calibration run of thirty-two coins, and this is represented by process block 148. Then, as represented by process block 149, an average value is calculated from thirty-two readings for edge thickness. As represented by process block 150, the coin discriminator/offsort processor then executes program instructions to confirm that each item of coin data is within four (4) standard deviations of an average value before the calibration is confirmed. If the calibration is not confirmed, a "recalibration" message is generated. After the execution of block 150, the routine is exited to return to the main/startup loop of FIG. 8, as represented by return block 151.

Referring back to FIG. 8, if the accept/reject routine is to be executed as a result of executing decision block 137, the coin discriminator/offsort processor proceeds to the routine illustrated in FIG. 10. After entering this routine, as represented by start block 152, the coin discriminator/offsort processor executes instructions represented by input block 153 to read six data readings from the sensor module 53, including readings for size, thickness and two readings each (voltage and frequency) for surface alloy composition and core alloy composition. As represented by process block 154, the processor then executes instructions to use the voltage data for the core alloy composition to determine the proper frequency range for the respective coin denomination/alloy specification. This process is next performed for the surface alloy voltage and frequency. Next, as represented by process block 155, the parameters for coin size, thickness, core alloy frequency and surface alloy frequency are tested to see if these numbers are within range for a single corresponding respective coin denomination/alloy specification. If the data is not within range of a first selected and active coin denomination/alloy specification, a comparison is made with the limits for the next and active denomination/alloy specification, until all active coin denomination/alloy specifications have been tested. Calculations that require long execution times have been previously performed in the execution of the routines illustrated in FIGS. 8 and 9. The routine illustrated in FIG. 10 executes very quickly to allow for processing of up to 4500 coins per minute. After each active coin denomination/alloy specification is checked, decision block 156 is executed to see if this is the last active coin denomination/alloy specification, and if the result is "NO", the routine loops back to execute process block 155. When the result is "YES," the routine proceeds to set a flag to accept or reject the coin as represented by decision block 157. Depending on an accept/reject determination in decision block 157, the processor proceeds to generate an accept pulse to coin ejector mechanism 32, as represented by process block 158, or a reject pulse, as represented by process block 159, to operate the coin ejector mechanism 32. After one of these actions, the routine returns to the main loop/startup routine of FIG. 8 as represented by return block 160.

From this it can be understood how data from the various sensors on the sensor module 40 is used to accept and reject coins for eighteen coin specifications, besides identifying the coin denomination by coin size. The optical imaging and coin discrimination sensors are part of a single coin sensor assembly 40 which can handle coins fed up to 4500 per minute past the coin sensor station 40.

This has been a description of preferred embodiments of the invention. Those of ordinary skill in the art will recognize that modifications might be made while still coming within the scope and spirit of the present invention as will become apparent from the appended claims.

We claim:

1. A method of sensing coins as the coins are processed by coin processing equipment, the method comprising:

moving the coins in a file of coins of mixed denomination through a coin sensor area, the coins having faces that slide over the coin sensor area;

optically sensing a coin dimension of each coin with an optical sensor disposed for sensing coins in the coin sensor area;

sensing coin alloy content in at least a portion of each coin with a plurality of alloy detection sensors disposed in the coin sensor area;

providing corresponding microelectronic processors for each of the optical and alloy detection sensors; and wherein the corresponding microelectronic processors receive signals from the optical and alloy detection sensors and provide respective data in parallel to an interface controller processor; and combining the coin sensor area, the optical and coin alloy sensors and the corresponding microelectronic processors and the interface controller processor into a single coin sensor assembly for insertion into a coin processing machine.

2. The method of claim 1, wherein sensing coin alloy content in at least one portion of each coin further comprises sensing coin core alloy composition and further comprises sensing coin surface alloy composition.

3. The method of claim 2, wherein the optical sensing of each coin is carried out by directing optical waves from one side of a coin sorting path through the coin sorting path and detecting light or shadow on an opposite side of the coin sorting path.

4. The method of claim 2, wherein a thickness of each coin is sensed by a sensor positioned to sense edges of coins moving through the coin sensor area; and wherein thickness is sensed in combination with an edge alloy composition of the coin.

5. The method of claim 1, wherein the optical sensing of each coin is carried out by directing optical waves through a solid portion of a light-transmissive, rotatable coin moving member disposed between a light source and the coins while moving the file of coins along a coin sorting path prior to sorting.

6. The method of claim 1, wherein optical sensing of each coin produces data which is separated as coin dimension data and data resulting from webs of light transmissive material in a rotatable coin member for moving coins along the coin path.

7. The method of claim 1, wherein the sensing of alloy content is carried out using at least one sensor located on one side of the coin path including a sensor facing edges of coins moving through the coin sensor area.

8. The method of claim 1, wherein said sensing of the coin dimension and the coin alloy composition is carried out at a rate of greater than 3000 coins per minute.

9. A coin sensor for operation with an external light source, the coin sensor comprising:

a coin path area for supporting a file of coins of mixed denomination, the coins having faces that slide over the coin path area prior to any sorting of the coins, the coin path area having at least a portion that is light transmissive;

an optical detector for detecting a coin dimension of each coin as the file of coins of mixed denomination passes the light transmissive portion of the coin path area;

a plurality of alloy detection sensors disposed in the coin path area for sensing coin alloy content of at least one portion of each coin as the file of coins of mixed denomination passes the coin path area;

an interface controller processor; and at least three corresponding microelectronic processors for receiving signals from the optical detector and the alloy detection sensors, respectively, and for providing respective data in parallel to an interface controller processor; and wherein the optical detector and the alloy detection sensors, the corresponding microelectronic processors and the interface controller processor are assembled in a coin sensor assembly with the light transmissive portion of the coin path area for insertion into a coin processing machine.

10. The sensor of claim 9, wherein the plurality of alloy detection sensors further comprise at least two sensors for sensing alloy content in different portions of each coin.

11. The sensor of claim 10, further comprising a third sensor for sensing an edge parameter from an edge of each coin.

12. The sensor of claim 11, wherein the edge parameter includes a thickness of each coin.

13. The sensor of claim 11, wherein the edge parameter includes the alloy content of each coin.

14. The sensor of claim 9, wherein the optical detector is a linear pixel array of optical detector elements.

15. The sensor of claim 14, further comprising a linear lens array positioned between the coin path and the linear pixel array to transmit light from the light source to respective elements in the linear pixel array of optical detector elements.

16. The sensor of claim 9, in combination with a rotatable drive member having a solid portion of light transmissive material, wherein said solid portion of light transmissive material is moved through a space between the light source and the coin path for moving coins over the coin path area.

17. The sensor of claim 9, in combination with a coin feeder for feeding coins over the coin path area at least at 3000 coins per minute.

18. The sensor of claim 9, wherein the coin path area has a surface portion of zirconia ceramic.

19. The sensor of claim 9, wherein the coin path area has a window aligned with the optical detector to allow passage of light thereto.

20. The sensor of claim 9, wherein the coin path area has an upper surface formed by a transparent member.

21. The sensor of claim 9, wherein the optical detector obtains multiple sets of size data from each coin, and wherein the optical detector calculates an average of such size data, to remove the effects on such image data from possible irregularities in the rims of the coins.

22. The sensor of claim 9, wherein said at least one sensor is in the coin path before the coin reaches the optical detector and further comprising a second sensor disposed in the coin path after the coin passes the optical detector.

23. A coin handling machine comprising:

a light source disposed on one side of a coin path over which a file of coins of mixed denomination travels prior to any sorting of the coins;

a coin path insert having at least a portion that is light transmissive, said coin path insert being detachable from the coin path;

a rotatable coin moving member made at least in part of light transmissive solid portion, wherein said light transmissive solid portion of said rotatable coin moving member is continually positioned between the light source and the coin path insert during rotation;

an optical detector for detecting coin size as a coin passes the coin path insert;

an electronic control portion for receiving data developed from signals from the optical detector; and wherein said data is for comparison with stored values for a plurality of denominations to determine the denomination of the coin.

24. The coin handling machine of claim 23, further comprising a sorting disc disposed opposite the coin moving member for sorting coins after they have passed the optical detector.

25. The coin handling machine of claim 23, wherein the optical detector is a linear pixel array of optical detector elements.

26. The coin handling machine of claim 25, further comprising a linear lens array positioned between the coin path insert and the linear pixel array to direct light from the light source to respective elements in the linear pixel array of optical detector elements.

27. The coin handling machine of claim 23, in combination with a coin feeder for feeding coins over the coin insert at least at 3000 coins per minute.

28. The coin handling machine of claim 23, wherein the coin path insert has a surface of zirconia ceramic.

29. The coin handling machine of claim 23, wherein the coin path insert has a sapphire window aligned with the optical detector to allow passage of light thereto.

30. The coin handling machine of claim 23, wherein the coin path insert has an entire upper surface for the passage of coins that is formed by a sapphire transparent member.

31. The coin handling machine of claim 23, further comprising:

a coin core alloy composition sensor for detecting coin core alloy composition as the coin passes the coin path insert;

a coin surface alloy composition sensor for detecting coin surface alloy composition as the coin passes the coin path insert; and wherein the electronic control portion receives data from the coin core alloy composition sensor and the coin surface alloy sensor for comparison with stored values for a plurality of coin specifications to determine if the coin should be accepted as meeting at least one of the coin specifications or should be rejected.

32. The coin handling machine of claim 31, further comprising:

an edge sensor disposed along a reference edge along the coin path for sensing a parameter from an edge of the coin as the coin passes the coin path insert; and wherein the electronic control portion receives data from the edge sensor for comparison with stored values for a plurality of coin specifications to determine if the coin should be accepted as meeting at least one of the coin specifications or should be rejected.

33. The coin handling machine of claim 32, wherein said electronic control portion comprises at least four processors for receiving data derived from corresponding signals from the optical detector, the coin surface alloy composition sensor, the coin core alloy composition sensor and the edge sensor, respectively.

34. The coin handling machine of claim 33, wherein said electronic control portion further comprises a fifth processor for receiving data from said four processors.

35. The coin handling machine of claim 32, in which the coin path insert, the optical detector, the coin core alloy composition sensor, the coin surface alloy and the edge sensor and the electronic control portion are all housed in a coin sensor housing assembly.

36. The coin handling machine of claim 35, wherein the coin sensor housing assembly is mounted below the coin path to support coins traveling over an upper surface of the coin path insert.

37. A method of identifying coins by denomination prior to sorting of the coins in coin sorting equipment, the method comprising:

moving the coins in a file of coins of mixed denomination through a coin sensor area;

optically sensing a coin dimension as each coin passes the coin sensor area in the file of coins of mixed denomination;

providing data for the coin dimension for comparison to stored values for a plurality of coin specifications to determine the denomination of each coin; and wherein the optical sensing of each coin is carried out by directing optical waves through a solid portion of a rotatable coin moving member as it moves the coins along a coin sorting path prior to sorting of the coins.

38. The method of claim 37, wherein the optical sensing of each coin is carried out by directing optical waves from one side of a coin sorting path through the coin sorting path and detecting light or shadow on an opposite side of the coin sorting path.

39. The method of claim 37, wherein optical sensing provides multiple sets of size data from each coin, and further comprising calculating an average of such size data to remove the effects of possible irregularities in the rims of the coins.

40. The method of claim 37, wherein optical sensing of the coin also provides additional data resulting from rotation of a rotatable coin moving member having webs of light transmissive material moving along the coin path with the coin, and wherein said additional data is separated from said coin dimension data for comparison to stored values for a plurality of coin specifications to determine the denomination of the coin.

* * * * *